United States Patent [19]

Leistritz

[11] 4,318,887

[45] Mar. 9, 1982

[54] HEAT EXCHANGE AFTERBURNER AND MUFFLER APPARATUS FOR ENGINE EXHAUST GASES

[76] Inventor: Hans K. Leistritz, Stegwiesen 8, D 7891 Küssaberg 2, Fed. Rep. of Germany

[21] Appl. No.: 202,624

[22] Filed: Oct. 31, 1980

[30] Foreign Application Priority Data

Nov. 2, 1979 [DE] Fed. Rep. of Germany ..... 2944168
Nov. 22, 1979 [DE] Fed. Rep. of Germany ..... 2947058

[51] Int. Cl.[3] ..... F01N 3/10
[52] U.S. Cl. ..... 422/173
[58] Field of Search ..... 422/170, 172, 173, 176, 422/182, 183; 60/298, 303, 220

[56] References Cited

U.S. PATENT DOCUMENTS

| | | | |
|---|---|---|---|
| 1,848,990 | 3/1932 | Boyd et al. | 60/303 X |
| 3,254,963 | 6/1966 | Leistritz | 422/176 |
| 3,347,040 | 10/1967 | Leistritz | 60/285 |
| 3,645,093 | 2/1972 | Thomas | 60/303 |

FOREIGN PATENT DOCUMENTS

| | | | |
|---|---|---|---|
| 2352965 | 4/1975 | Fed. Rep. of Germany | 422/173 |
| 2638350 | 3/1978 | Fed. Rep. of Germany | 422/173 |
| 2723747 | 11/1978 | Fed. Rep. of Germany | 422/182 |
| 2800386 | 7/1979 | Fed. Rep. of Germany | 60/303 |
| 1120611 | 7/1968 | United Kingdom | 60/303 |

*Primary Examiner*—William A. Cuchlinski, Jr.
*Attorney, Agent, or Firm*—Watson, Cole, Grindle & Watson

[57] ABSTRACT

In a thermal afterburner and muffler for internal combustion engine exhaust gases, an elongated counterflow first combustion chamber has a central inlet for receiving the exhaust gases. A second combustion chamber includes first and second combustion regions, with the first combustion region receiving exhaust gases ejected from the first combustion chamber. The second combustion region includes a transversely extending baffle and an ignition element centrally located therein. A third combustion chamber includes first and second combustion compartments with the first combustion compartment surrounding the second combustion chamber and connected to the second combustion region through a partial flow-forming element and has a heat reflective inside surface area. The second combustion compartment surrounds the elongated combustion chamber and receives combustants from the first combustion compartment. A ceramic fibrous material at least partially surrounds the second combustion compartment. An elongated axially extending duct interconnects an exhaust outlet of the afterburner and the outlet of the second combustion compartment.

13 Claims, 5 Drawing Figures

HEAT EXCHANGE AFTERBURNER AND MUFFLER APPARATUS FOR ENGINE EXHAUST GASES

BACKGROUND OF THE INVENTION

1. Field of the Invention

The invention relates to thermal afterburning systems and more particularly to such systems using a plurality of combustion chambers and concentrically arranged counterflow cooling ducts for mixing the engine exhaust gases with air and for cooling the burned exhaust gases and toxic contaminants.

2. Prior Art

The invention represents an improved thermal afterburning system over that disclosed in U.S. Pat. No. 3,989,469. That prior art thermal afterburner consists of the following basic components. An elongated counterflow combustion chamber receiving exhaust gases to be afterburned and additional combustion air. A cooling air chamber encircling the combustion chamber and directing heated cooling air into the combustion chamber. The combustion chamber includes a discharge chamber at the downstream end thereof, and a number of ducts having relatively small cross-section and separated from one another are connected to the discharge chamber for discharge of afterburned exhaust gas therefrom. The ducts have a wall forming a joint heat exchange surface with an outer wall of the cooling air chamber such that the ducts are separated from the combustion chamber over their entire length.

Such a counterflow cooling system has given rise to serious manufacturing problems, because the creation of thin pipelines from chrome steel which, simultaneously with a surrounding air chamber, have direct heat-exchange surfaces, is very expensive and heat-expansion phenomena have occurred in the apparatus which have led to crack formation.

Furthermore, the process of mixing exhaust gas and supplementary air in a single counterflow combustion chamber has not been intensive, thus necessitating exceedingly large combustion chambers.

Also, "lean" carburetor adjustment in the engines which, particularly in the partial-load operating region, are set with $\lambda = \pm 1.1$ has not produced sufficient post-combustion energy to maintain the thermal equilibrium inside the combustion chamber.

Finally, steps have to be taken to remove the sooty carbon deposit in addition to the reduction of CO, HC and $NO_x$.

SUMMARY OF THE INVENTION

The invention comprises four groups of steps for eliminating the deficiencies of the aforementioned type thermal afterburner construction.

(1a) A hollow aluminum section is incorporated into an air-suction chamber surrounding a main section of the afterburner, and having a large inner space and a large number of external individual air ducts within double walls. The air ducts are separated from one another by partitions.

(1b) The exhaust discharge pipes of the afterburner with reduced cross sections pass the air ducts of the hollow aluminum section, and are made of copper or chrome steel, and open into a discharge pipe through a discharge chamber.

(1c) The air heated by the counterflow arrangement set forth in the exhaust discharge pipes enters into a further air-preheating chamber, into which extends the primary mixing combustion chamber with an upstream opening.

(1d) The inner wall of the hollow aluminum section is separated from a wall of the tertiary combustion chamber by a layer of ceramic fibers which have no heat-storing effect and are pervious to some of the heat radiation, so that the hollow aluminum section is heated to approximately 400° C. by the tertiary combustion chamber which operates at approximately 700° C. The radiation heat of the discharge pipes also contributes to such heating, a temperature of approximately 700° C. being measured upstream in these discharge pipes and approximately 400° C. downstream.

(2a) The injector of the thermal afterburner system is improved by an exhaust/pilot jet which emanates from a centrally disposed tube traversing the primary mixing combustion chamber and has a phase lead with respect to another group of exhaust inlets. The exhaust intake of the tube lies closer to the engine outlet than that of other tubing which provide the other group of exhaust inlets. Thus, the pilot jet is a hot-gas jet with a high flow rate.

(2b) Around the hot-gas jet entering the secondary combustion chamber through a constructed orifice a fine-jet component directs jets of auxiliary air from the periphery of the secondary combustion chamber obliquely into the pilot jet and onto an ignition element.

(2c) Against a baffle at one end of the thermal afterburner system the exhaust/air medium runs centrifugally from the center to a group of fine openings, where passage occurs from the secondary to the tertiary combustion chamber provided with a star or radial burner fitted upstream thereto, which embraces the entire periphery of the tertiary combustion chamber and in which the exhaust/air medium, which flows up obliquely, is mixed with blast air likewise fed from a fine-jet element.

(3a) The exhaust intake section includes both a short and a long path extending from the engine outlet and both paths are separated from one another by a control element, so that the fuel mixture can be drawn into the afterburner via either the short or long paths, or both paths simultaneously.

(3b) The control element is dependent upon the volumetric efficiency of the engine such that with a cold start and partial-load charging the short path is selected and with full-load charging the long path is chosen.

(3c) To achieve optimum engine power, each full-load adjustment requires a long-duct adjustment and a $\lambda < 1$ (i.e., large deposit of toxic substances with large afterburner heat). To effect internal cooling of the afterburner, long-duct adjustment, which always results in a cooler engine exhaust, is advisable. However, each partial-load adjustment results in fewer toxic substances and less afterburner heat. To keep the afterburner at a high temperature in this condition also, short-path charging of the afterburner is employed for this mode. In the case of Otto 4-cycle engines with a temperature of approximately 850° C. in the engine outlet, a temperature of approximately 900°-1000° C. must be maintained in this manner, even though only little insulation is employed in this zone.

(3d) Even when there is little or no sooty carbon deposit, the afterburner constantly tends to burn up immediately upon arrival of toxic substances, since hot air and an ignition element are present in the combustion chamber. For example, upon entering a town or village after rapid highway travel with "lean" carburetor adjustment, afterburning starts immediately. Furthermore, the operation of the afterburner requires no additional energy by the engine (i.e., no additional consumption of motor fuel).

(4a) The fine-jet producing elements are formed by a layer of high-grade steel and wire cloth with at least a triple thread system (so-called galloon fabric) and having an action tending to filter airborne particles. Such fabrics have a self-cleaning action, because with adequate residence time soot has an ignition temperature ranging from 320° to 440° C.

(4b) The invention provides excellent results with diesel engines if the afterburner is linked to the engine outlet with a very short connection. The diesel engine must then be warmed up in the cold state for a brief period, during which toxic substances are burned up (as in Otto cycle engines), that is to say, with the aid of supplementary air (despite the fact that the diesel engine in the hot state has an excess of oxygen); by means of a material with adequate storage capability a stabilized hot state must then be created, about 150° C. higher than the temperature of the diesel exhaust at the engine outlet (approximately 450°-550° C.), because with a designable burnoff of hydrocarbons an adequate thermal equilibrium can thereupon be established. The supplementary-air flow of the afterburner can be reduced after the hot state has been attained.

(4c) In Otto cycle engines which, in the cold state, exhibit a sooty carbon deposit, no further steps are necessary, apart from a cold-start control of the engine which operates in dependence upon the afterburner temperature.

DETAILED DESCRIPTION

Figure 1:
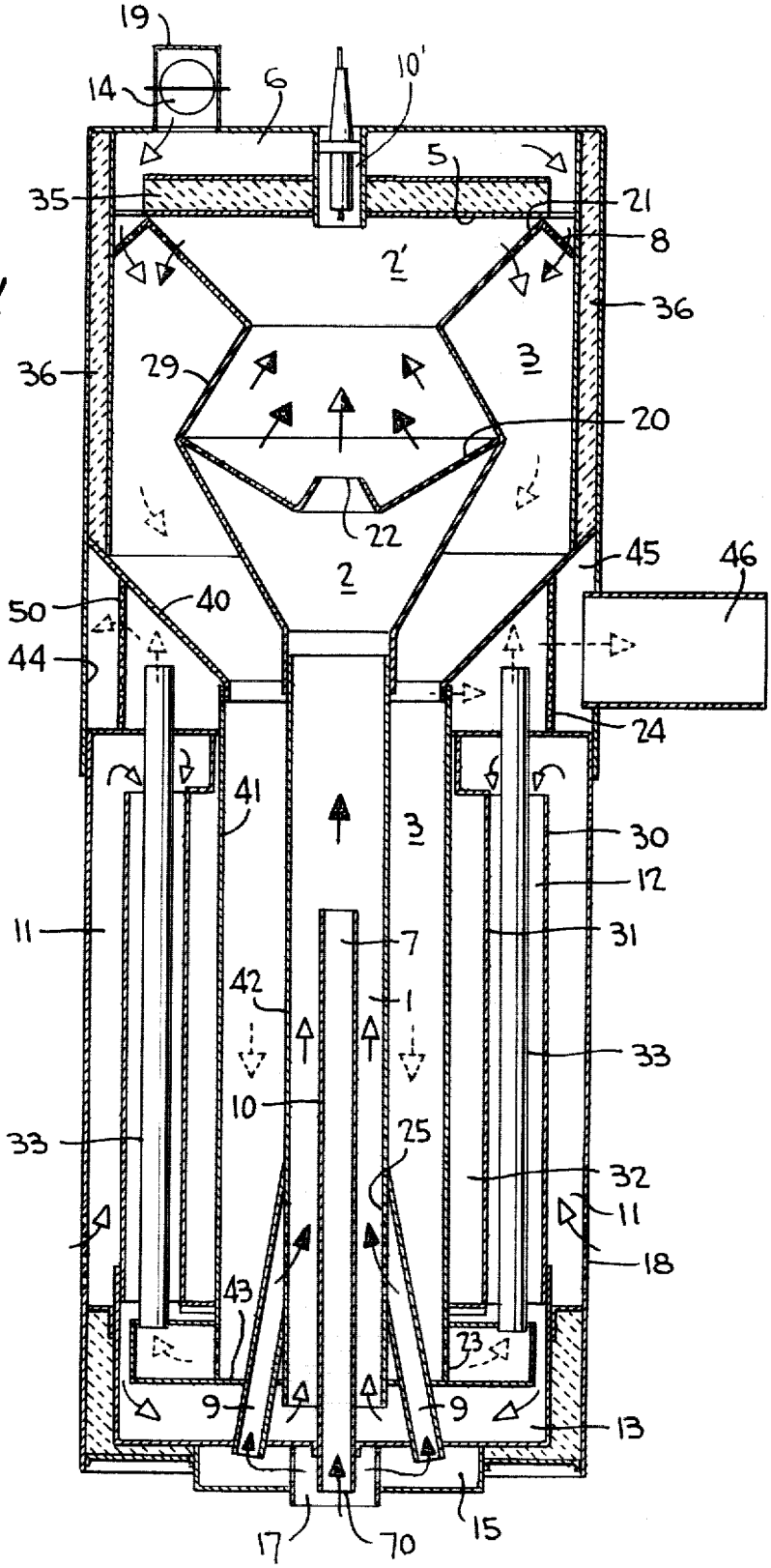
FIG. 1 is a cross-sectional view of an embodiment of the invention.

The drawings are schematic representations in which the black arrow indicates the path of the unpurified exhaust gas, the black arrow with the white field a mixture of exhaust gas and supplementary air, the white arrow supplementary air, and the white arrow with the dashed line afterburning or afterburned exhaust gas. After escaping from exhaust pipe 17, the unpurified exhaust gas follows two paths: a short path to the combustion chamber by entering injection pipe 10, and a longer path to the distribution chamber via injection pipes 9. Injection pipes 9 and 10 form an air injector. A subpressure with air suction (white arrows) is produced in the upstream section of the mixing/combustion chamber 1 by pilot jet 7 escaping from injection pipe 10. Carried by air currents the gaseous mixture in injection pipes 9, which is divided into partial jets, travels to form a first mixture of exhaust gas and air. After the first pulsations, the leading pilot jet 7 carries air particles and traverses central orifice 22 of partial-flow-producing element 20, through which passes most of the other mediums, and in the downstream section of combustion chamber 2 there arises in the axial zone, directed at ignition element 10', a concentrated turbulence, which increases the spread of combustion at a higher rate than the present ignition rate. Since, due to its higher flow rate, pilot jet 7 preserves its flowing continuity over a long distance, it also conveys its inherent pulse characteristics to ignition-element zone 2' of combustion chamber 2. In addition to promoting the flow turbulence, ignition-element zone 2' also produces relative motions between the pulsating exhaust particles and the more inert air particles, a phenomenon which also enhances the ignition quality. Because the conical restriction of combustion-chamber wall 29 drives the mixture of gas and air to the center of ignition-element zone 2', there appears on baffle 5 (as an equality of contrast principle) a somewhat planar outflow in which the current subsides and thorough mixing takes place, which terminates at partial-flow forming element 21. During this settling-down phase of a broadly based radial burner, the final combustion phase starts with an oblique intake 8 of air-particle flow in the upstream section of combustion chamber 3. With this passage from the pulse phase in combustion chambers 1 and 2, which is utilized with its advantages for thorough mixing and ignition quality, to the settling-down phase with the arrangement in a geometrical pattern of star burner 36 with a reduced flow rate and large combustion chamber 3 downstream, the residence-time conditions within a high-temperature range between 700° and 900° C. which, as is known, are of prime importance to $NO_x$ reduction, are satisfied. Since blast pressure is also employed to draw this air in and a direct dependency upon the gas producer of the internal combustion engine is provided by throttle plate 14, the quantization of the incoming quantities of gas without time lag corresponds to the quantity of supplementary air required at the site of star burner 36 and drawn in as a complement to the premixing of injector air. This premixing of air by means of injector air and partial-flow producing elements 25, 20 and 21, and by the turbulent flows produced in combustion chambers 1, 2, leads to a space deep combustion during the final burnoff and not only to a thin, flat "shell combustion" on the surface of spherical gas quanta, such as occurs in any only short region of paths of a combination of heating gas and air jets. Therefore, the long foresection formed by combustion chambers 1 and 2 is an absolute necessity for the full-load charging mode of the engine, as has been demonstrated in experiments.

Moreover, this forsection, including combustion chamber 3, contains three follow-up sequential chambers for the burnoff process according to the increasing flow pressure and the increasing quantity of exhaust gas flowing in from the internal combustion engine according to the main operating phases, i.e., no load, partial load, and full load, as the charging element of the afterburner. The no-load burnoff occurs in combustion chamber 1, the partial load burnoff in combustion chamber 2, and the full-load burnoff in combustion chamber 3.

The thermodynamic merit of the flow-reversing combustion chamber lies in the counterflow arrangement of incoming unpurified gas and outgoing purified gas, with the result that afterburner heat flows into the charging system of the afterburner during the thermal recycling. In the construction described herein, such recycling is materially improved by the incorporation of a hollow aluminum section. A major portion of the afterburner is surrounded by air-suction chamber 11. FIG. 1 shows such an injector-operated air-suction path starting from openings 18 and terminating in a final air-heating chamber 13, from which the supplementary air travels to combustion chamber 1. In the air-suction path the air passes a large number of ducts 12 of a hollow aluminum section situated between double walls 30 and 31 and separated from one another by partitions not shown in the diagram.

With the aid of the direct heat radiation from wall 41 of the combustion chamber 3, in which during thermal equilibrium there is a temperature of about 800° C., through a ceramic fibrous material 32 which is partly pervious to heat, and by means of thin-walled copper or chrome-steel ducts 33 which pass aluminum ducts 12 axially and are charged at the entrance with an exhaust temperature of about 700° C., afterburner heat is transferred to the aluminum hollow body, which represents a comparatively large quantity of metal and absorbs afterburner heat very rapidly. In this way, not only is the excellent heat conductivity of aluminum utilized but, above all, by transforming a fairly large amount of metal into thermodynamically effective surfaces the prerequisite conditions are created for collecting a significant amount of heat in such a body, e.g., through radiation and transmission by thermal convection, i.e., the transfer of this thermal energy by means of air which passes therethrough, to the site where the apparatus is situated and where this heat energy is employed in the manner provided, viz. in the combustion chamber. In thermodynamic theory, this is referred to as increasing the degree of heat conductivity, because the heat-transfer capacity is increased considerably. In this type of afterburner, that is a complement to the combustion chamber construction in which a pilot jet of hot gas 7 performs a similar heat-transfer function. In the latter case, engine heat is recycled, in the former case afterburner heat. The hollow aluminum section is set to about 400° C. when designing the apparatus. Unlike true heat-transfer devices, it produces thermal flow from a kind of "heat container" which exerts its stabilizing influence without the inertia of ceramic storage materials and which, already during the brief warm-up period from cold start, gathers a considerable amount of heat. Since during thermal equilibrium the temperature of chrome-steel wall 41 is approximately 800° C., it can be braced mechanically with the aluminum body without using expansion bellows, because the thermal expansion of aluminum is approximately twice as large as that of steel. In this way, a very solid carrying apparatus body is achieved in which the reduction of long-time strength of malleable aluminum alloys is completely negligible. The true fatigue strength of the hollow aluminum section resulting from double walls that are stabilized by partitions is a contributing factor. Since the heat loss of exhaust cooling pipes 33 traversing the hollow aluminum section between double walls 30, 31 within air ducts 12 must be reduced by 300° C. (measured in discharge chamber 45) after a travel of approximately 300 mm, the afterburner exhaust gas escaping therefrom can already act on the other side of wall region 40 as a cooling gas and can take part in an afterburner cooling chain which starts there.

Figure 2:
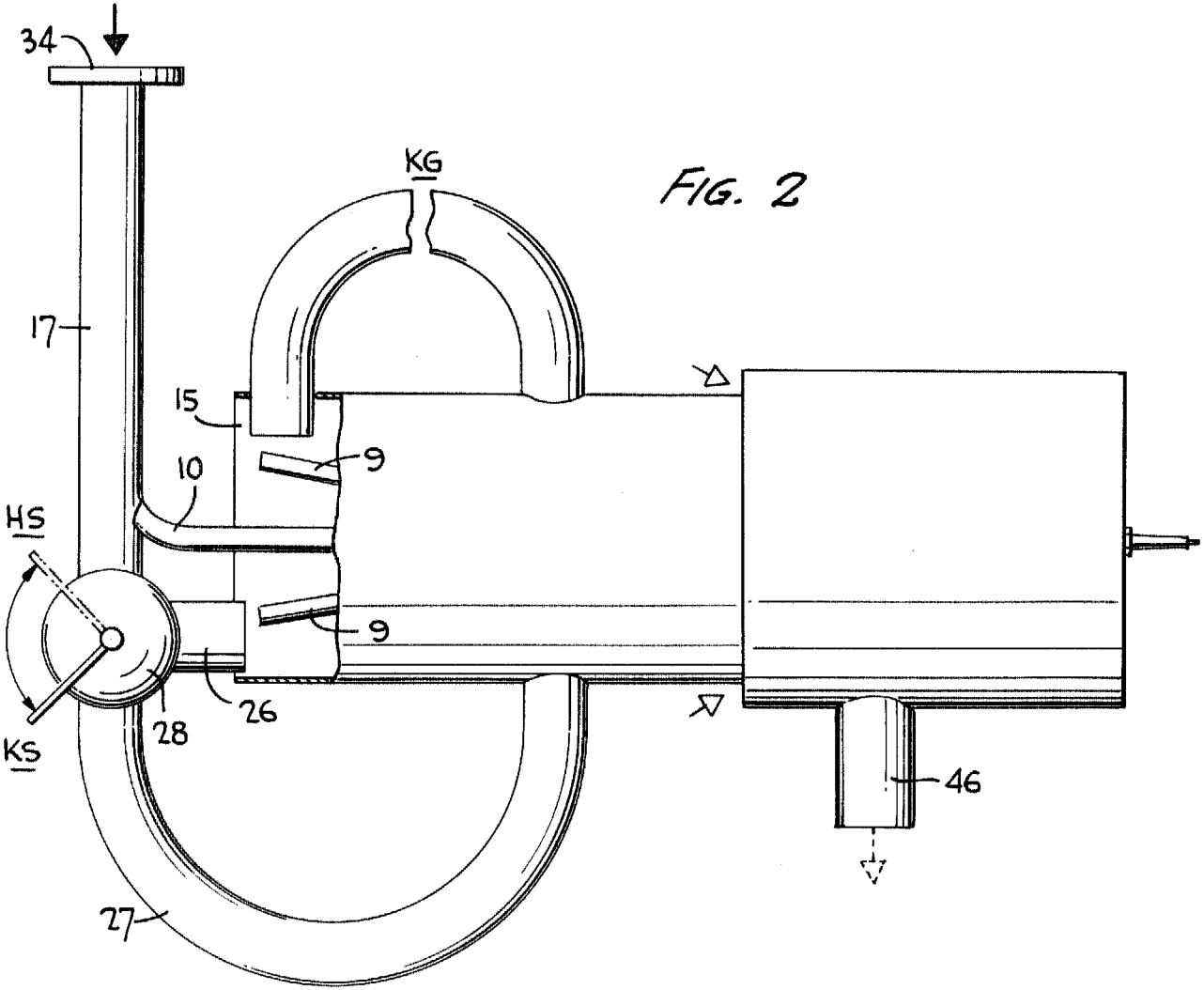
FIG. 2 illustrates the exhaust intake section of the thermal afterburner mechanism.

A no less significant thermodynamic ancillary unit is described in FIG. 2. For operating conditions where there is no afterburning due to extreme reduction of the toxic substance deposit as a result of adequate "lean" carburetor adjustments in the partial-load region, there is provided a hot gas path to exhaust pipe 17 starting from engine outlet 34 and entering via control element 28 directly into the afterburner. Since such "lean" adjustments from a $\lambda = 1.1$ bring in increasing amounts of toxic carbohydrates, their immediate burnoff occurs upon entrance into combustion chamber 1, because a sufficiently high temperature and hot air are present therein in the case of hot-gas adjustment. However, the cooling-gas adjustment with a long-tube inlet always causes cooler engine exhaust gas to flow in path 27. This factor can be increased at will by interposing cooling element KG in path 27. Since the power production of an internal combustion engine both in 4-stroke and 2-stroke engines requires cylindrical or conical long-tube outlets and in the case of full-load adjustments one must always operate with a $\lambda < 1$, this cooling-gas adjustment compensates for the greater afterburner heat produced by a greater toxic substance burnoff.

Figure 3:
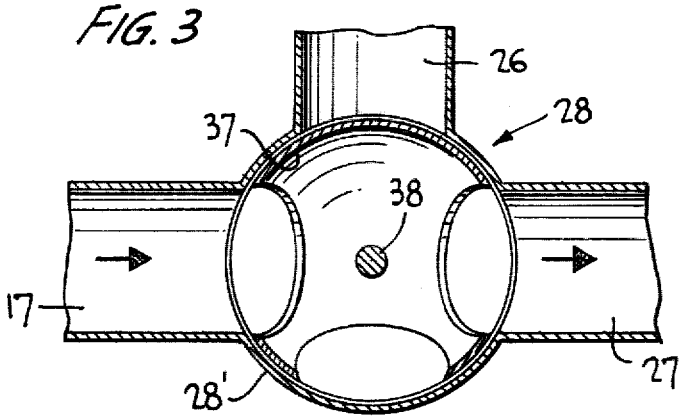
FIGS. 3-5 show respectively different operating modes of the exhaust intake section.
Figure 4:
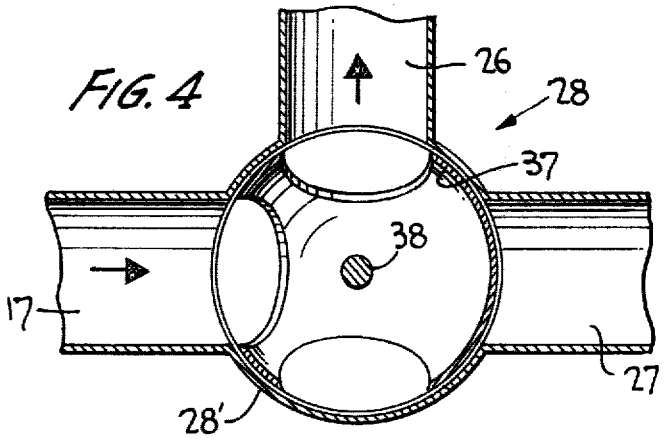
Figure 5:
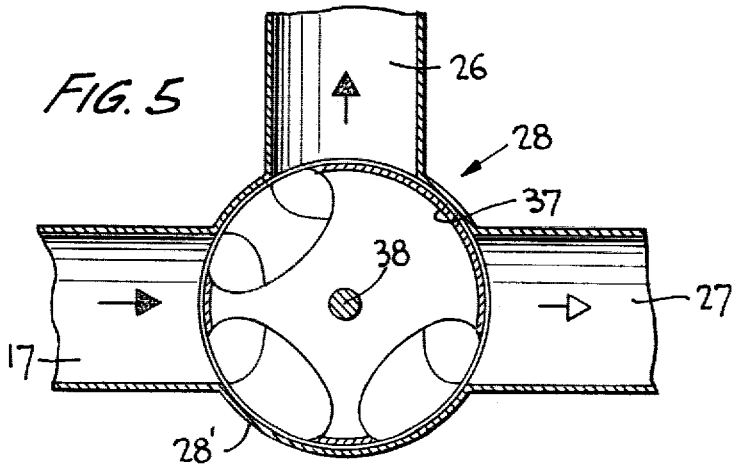

Control element 28 is an external hollow sphere with at least one exhaust feed line 17 and at least two exhaust outlets 26 and 27. Internal hollow sphere 37 with a short distance to the external hollow sphere on rod 38 is provided with spaced-apart recesses which are distributed in a geometrical pattern such that at least the arrangements shown in FIGS. 3–5 are possible. FIG. 3 shows no restriction of the exhaust-gas flow. FIG. 4 shows exhaust-gas flow into short path 26. FIG. 5 shows a position in which the exhaust is allowed to escape further into both short and long paths 26 and 27, respectively.

Flow-through element 50 in discharge chamber 46 of the thermal afterburner illustrated in FIG. 1 is a wire-cloth layer of high-grade steel which is suitable for filtering soot. It has a self-cleaning action when the temperature is around 400° C., at which temperature soot ignites without flame or spark. Partial-flow producing elements 20 and 21 may also be formed, either separately or additionally, with such a wire-cloth layer. Also wire cloths with at least a triple wire system already provided with a layer structure are placed within the indicated temperature range with a view to the self-cleaning action, at least in the combustion chambers. As described above, diesel engines require in this case a special warm-up stage from the cold state.

In accordance with the foregoing description there has been described apparatus for the thermic afterburning and muffling of the exhaust gases of internal combustion engines using an elongated counterflow combustion chamber at least partially surrounded by an air chamber directing heated cooling air into the combustion chamber and a number of separated ducts discharging afterburned exhaust gas and connected to a combustion chamber discharge pipe. Integrated into the air chamber is a hollow aluminum section formed by double wall 30 having a plurality of air flow conduits and a large internal space surrounded by wall 31 in which is situated a section of first combustion chamber 1 which is defined along the periphery thereof by chrome-steel wall 41. Supplementary air is introduced by means of an injector, possibly with initial blower pressure through openings such as openings 18 and with a supplementary blast in tertiary combustion chamber 3. A pilot jet 7 of exhaust gas flows ahead of the inflow current of exhaust gas and which, by means of special measures, has a higher temperature, a higher flow rate, and a more pronounced pulse characteristic than the remaining inflow current of exhaust gas through auxiliary injection pipes 9. The two first combustion-chamber stages 1, 2 each contain, surrounding pilot jet 7 or injection pipe 10 thereof, a partial-flow-forming element (25 in combustion chamber 1, and 20 in combustion chamber 2), from which, directed from the peripheral zone of the combustion chamber, obliquely downstream to the longitudinal axis of the afterburner device, a bundle of fine jets is fed with a mixture of exhaust gas and air. At least on circumferential wall 20 of combustion chamber 2 the confluence of the partial flows with pilot jet 7 occurring in the axial zone of the combustion chamber is supported by a partially conical narrowing of the walls 29.

In engines which, due to a high performance liter displacement or to special tuning of the torque configuration, require certain cylindrical or conical long-tube dimensionings and have at the same time a suitable "lean" charge in the zone of frequent partial-load adjustments with simultaneously reducible deposit of toxic substances, there is provision for short-path connections of the exhaust-gas intake path. This affords a thermal complement to the pilot jet from a low-loss flow of exhaust-gas heat of the engine into the thermal recycling system of the afterburner obtained by the heat reflection from walls 41, 42, 9, 43, 33 and 30 to the combustion chambers 1–3. The low-loss flow of exhaust gas heat provides a continuous disposition with respect to temperature level and amounts of oxygen to burn off toxic substances without additional energy requirements. The low-loss flow of exhaust gas also accelerates a cold start of the afterburner from a cold start of the engine with the enriched charging mixture of this operating phase.

Pilot jet 7 is formed by the exhaust gas in a zone between engine outlet 34 and exhaust-gas intake chamber 15 of the afterburner via exhaust-gas intake path 17 of the short-path connection, in the event the prerequisite conditions set forth immediately above are present. The pilot jet of exhaust gas 7, during the introduction of supplementary air, is simultaneously utilized by the injector mechanism for producing a subpressure within air-preheating chamber 13. The quantity of exhaust gas fed to the afterburner together with the pilot jet of exhaust gas 7 is fed through auxiliary injection pipes 9 which open into a partial-flow-forming element 25. The jets from auxiliary injection pipes 9 cause a turbulent mixing with the quantity of air flowing from the upstream opening of primary combustion chamber 1.

Within the incoming path of the supplementary air to primary combustion chamber 1 from the free atmosphere through openings 18, the air flows through ducts 12 of the hollow aluminum body formed by double wall 30. Regardless of whether there is injection of supplementary air, use of a blower provides injection with pre-pressure. In the case of a throughput of supplementary air through ducts 12 of the hollow aluminum section formed by wall 30, the rate of air flow through ducts 12 takes place within an annular chamber whose inner wall is made of a thin-walled copper or chrome-steel pipe, which form sequential chambers of the afterburner.

Heat is also introduced into the hollow aluminum section through radiation from tertiary combustion chamber 3 through the use of a matt of ceramic fibrous material 32 which limits the radiation transmission.

The feeding of supplementary air occurs with the aid of blast air or is supplemented thereby (air introduced through opening 18 or only as an additive quantity of supplementary air from inlet 19) and the allocation of the quantity of air by means of throttle plate 14 functions as a control element in the intake path of the internal combustion engine controlling the volumetric efficiency thereof.

The exhaust gas/air mixture blown axially against baffle plate 5 in the case of a simultaneous conical flare of secondary combustion chamber 2 flows in in a pine-cone-like centrifugal transverse current of peripheral wall 29 which is provided with a group of fine apertures 21, and after passage into tertiary combustion chamber 3 flows obliquely (at approximately 90°) by partial currents of blast air through oblique intake 8.

After the final burnoff phase in the upward section of tertiary combustion chamber 3 a continuous cooling chain comes into action up to outlet 46 of the afterburner device through heat flow in the following walls: in wall 40 (afterburner exhaust gas cooled on the other side); in wall 41 (heat radiation in aluminum wall 31 on the other side); in wall 42 (heat flow in cooler mixture of exhaust gas and supplementary air on the other side; in outer walls of auxiliary injectors 9 (cooler engine exhaust gas on the other side); and in all walls of tubes 33 (throughput of supplementary air on the other side).

In the discharge line, or in one of the sequential chambers, there is provided a thermobimetal group which "leans" the exhaust gas/air mixture ratio of the internal combustion engine as a function of the warmup of the afterburner and contains corrective quantities which ensure conformity with the warmup conditions of the internal combustion engine.

In one zone of the thermal equilibrium between 400° and 600° C. there is provided, as a flow-through region for the entire quantity of exhaust gas, an area of wire-cloth 50 made of high-grade steel which assists in the burnoff of the combustion particulates (soot) and has a self-cleaning action in addition to its filtering action. Such a layer of wire-cloth may also be located in tertiary combustion chamber 3 or one of the sequential chambers (e.g., 45 in FIG. 1). The partial-flow-producing elements 20 and/or 21 of secondary combustion chamber 2 may consist of a layer of metal cloth as set forth above.

A special layer-like weave type is employed as a wire-cloth made of more than two wire networks crossing at right angles to one another and at least a third wire network which, in contrast to a linear arrangement of the wires, is formed as deflecting baffles into the spatial dimension of the layer and allows passage through inwardly disposed very fine openings due to a surrounding latticework.

Burner 35 and the circumferential wall of tertiary combustion chamber 3 are lined at least partially with heat-storing ceramic, in contradistinction to ceramic fibers 32.

Within the exhaust-gas supply line from engine outlet 34 to afterburner intake chamber 15 a short-tuning tube 17 and a long-tuning tube 17+27, and interposed control element 28 enables at least three adjustments of the volumetric efficiency of the engine combustion chamber as a function of engine RPM, namely, long-tube charging of the afterburner (FIG. 3, from 17 to 27), short-tube charging of the afterburner (FIG. 4, from 17 to 26), charging in both lines (FIG. 5, from 17 to 26 and 27). Moreover, any type of supplementary cooling means KG (e.g., a radiator) may be integrated into long-tube path 27. Control element (28 in FIGS. 2 to 5) consists of an outer hollow sphere (28' in FIGS. 3–5) into the interior of which there is at least one exhaust-gas intake pipe 17 and at least two discharge pipes 26 and 27. In the interior of outer hollow sphere 28' there is pivotally mounted with relatively little spacing an inner hollow sphere 37 on a rod which penetrates the outer hollow sphere, in such a way that incoming exhaust gas from supply pipe 17 continues to flow—apart from into the exposed interspace between the two hollow spheres—via recesses in the surface of inner hollow sphere 37 and into one of the two discharge pipes 17 and 27 (FIGS. 3 and 4), or into both discharge pipes (FIG. 5). These different control positions can be brought about by rotating rod 38 from outside the concentric spheres.

What is claimed is:

1. Apparatus for the thermal afterburning and muffling of internal combustion engine exhaust gases, comprising:

an elongated counterflow first combustion chamber having a central inlet for receiving exhaust gases;

an exhaust-gas intake chamber surrounding said central inlet, said elongated counterflow combustion chamber including auxiliary injection inlets extending from said exhaust-gas intake chamber into said counterflow combustion chamber, and an air preheating chamber for introducing supplemental air into said elongated counterflow combustion chamber around said central inlet such that said supplemental air mixes with the exhaust gases injected through said auxiliary injection inlets;

a second combustion chamber for receiving exhaust gases ejected from said first combustion chamber and including first and second combustion regions, said second combustion region including a transversely extending baffle and an ignition element centrally located therein;

a third combustion chamber including a first combustion compartment surrounding said second combustion chamber and connected to said second combustion region through a partial flow-forming element and having a heat reflective inside surface area, and further including a second combustion compartment surrounding said elongated combustion chamber and receiving combustants from said first combustion compartment;

a ceramic fibrous material at least partially surrounding said second combustion compartment;

an exhaust outlet; and an elongated axially extending duct interconnecting said exhaust outlet and the outlet of said second combustion compartment.

2. Apparatus as in claim 1 further comprising a double-walled hollow chamber surrounding said ceramic fibrous material and through which said elongated axially extending duct extends, said hollow chamber receiving supplemental air and being interconnected with said means for introducing supplemental air around said central inlet.

3. Apparatus as in claim 2 wherein said first combustion region includes a partial flow-producing element having a central inlet interconnecting with said first combustion chamber.

4. Apparatus as in claim 3 wherein said third combustion chamber includes a wall member formed by a star burner.

5. Apparatus as in claim 4 wherein the inner wall of said double-walled hollow chamber is made of thin-walled copper or chrome steel.

6. Apparatus as in claim 5 wherein said first combustion compartment includes means for introducing supplemental air, and a throttle control for controlling the injection of supplemental air.

7. Apparatus as in claim 6 wherein said means for introducing supplemental air includes an oblique outlet into said first combustion compartment.

8. Apparatus as in claim 7 further comprising a wire-cloth element mounted between said exhaust outlet and said elongated axially extending duct.

9. Apparatus as in claim 1 wherein said partial flow-forming element is a wire cloth.

10. Apparatus as in claim 1 wherein said second compartment is at least partially enclosed with heat-storing ceramic.

11. Apparatus as in claim 1 further comprising a control element for controlling the flow of exhaust gases from the engine into said central inlet, a short tuning tube interconnecting the engine outlet with said exhaust outlet through said control element and a long tuning tube interconnecting said control element and said central inlet, said control element enabling short tube charging, long tube charging, and both short and long tube charging of the afterburner.

12. Apparatus as in claim 11 further comprising means for cooling the exhaust gases in said long tuning tube.

13. An elongated counterflow combustion chamber for the thermic afterburning and muffling of the exhaust gases of internal combustion engines, comprising:

a primary burning zone including an air injection system;

a secondary burning zone including a reflection wall and ignition element;

a partial-flow forming element in a tertiary burning zone surrounding said primary and secondary burning zones;

an air flow chamber partially surrounding said tertiary burning zone;

a double-walled hollow chamber integrated into said air flow chamber;

elongated ducts between said double walls for receiving supplemental air and being interconnected with said air injection system, said ducts being traversed by tubes having a small cross-section of thin-walled copper or chrome steel for discharging afterburned exhaust gas;

another group of exhaust inlets;

an exhaust flash pilot jet traversing said primary burning zone with a phase lead with respect to said another group of exhaust inlets and including an exhaust intake closer to the engine outlet than said another group of exhaust inlets, which receive the exhaust gas subsequent to the exhaust gas delivered inside the afterburner; and a switching pipe for transporting uncooled heated gas in the afterburner.

* * * * *